United States Patent [19]

Wirz

[11] Patent Number: 4,621,576

[45] Date of Patent: Nov. 11, 1986

[54] SHEET-FED ROTARY PRINTING PRESSES FOR SINGLE-SIDE PRINTING OR FIRST FORM AND PERFECTOR PRINTING

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 735,853

[22] Filed: May 20, 1985

[30] Foreign Application Priority Data

May 18, 1984 [DE] Fed. Rep. of Germany ..... 3418443

[51] Int. Cl.[4] ..... B41F 13/44

[52] U.S. Cl. ..... 101/230; 101/217

[58] Field of Search ..... 101/230, 141, 153, 174, 101/216, 217, DIG. 28

[56] References Cited

U.S. PATENT DOCUMENTS

| | | | |
|---|---|---|---|
| 517,908 | 4/1894 | Wendte | 101/174 |
| 578,739 | 3/1897 | Harris | 101/230 |
| 2,479,023 | 8/1949 | Peyrebrune et al. | 101/216 X |
| 2,557,381 | 6/1951 | Huebner . | |
| 3,470,816 | 10/1969 | Piecha et al. | 101/220 X |
| 4,188,883 | 2/1980 | Schone et al. | 101/230 X |
| 4,378,734 | 4/1983 | Wirz | 101/230 |

*Primary Examiner*—William Pieprz

*Assistant Examiner*—John A. Weresh

*Attorney, Agent, or Firm*—Herbert L. Lerner; Laurence A. Greenberg

[57] ABSTRACT

Sheet-fed rotary printing press for single-side multicolor printing or for first form and perfector printing having a plurality of printing units disposed in tandem and having devices for processing both paper as well as heavier paperboard, each of the plurality of printing units having a plate cylinder and a blanket cylinder of equal given diameter in mutually cooperative relationship as well as an impression cylinder operatively engaging the blanket cylinder and having a diameter double the given diameter, and a sheet transfer cylinder in mutually cooperative relationship with the impression cylinder, each of the printing units includes an upper part and a lower part, the lower part thereof having two opposite side walls each formed with two bearing holes, respectively, located vertically above one another for receiving therein respective bearings for sheet transfer cylinders, the lower of the two vertically disposed bearing holes being of such size as to accommodate a bearing for a journal of a sheet transfer cylinder having a diameter triple that of the given diameter, and the upper of the bearing holes being of such size as to accommodate a bearing for a journal of a sheet transfer cylinder having a diameter double that of the given diameter.

3 Claims, 1 Drawing Figure

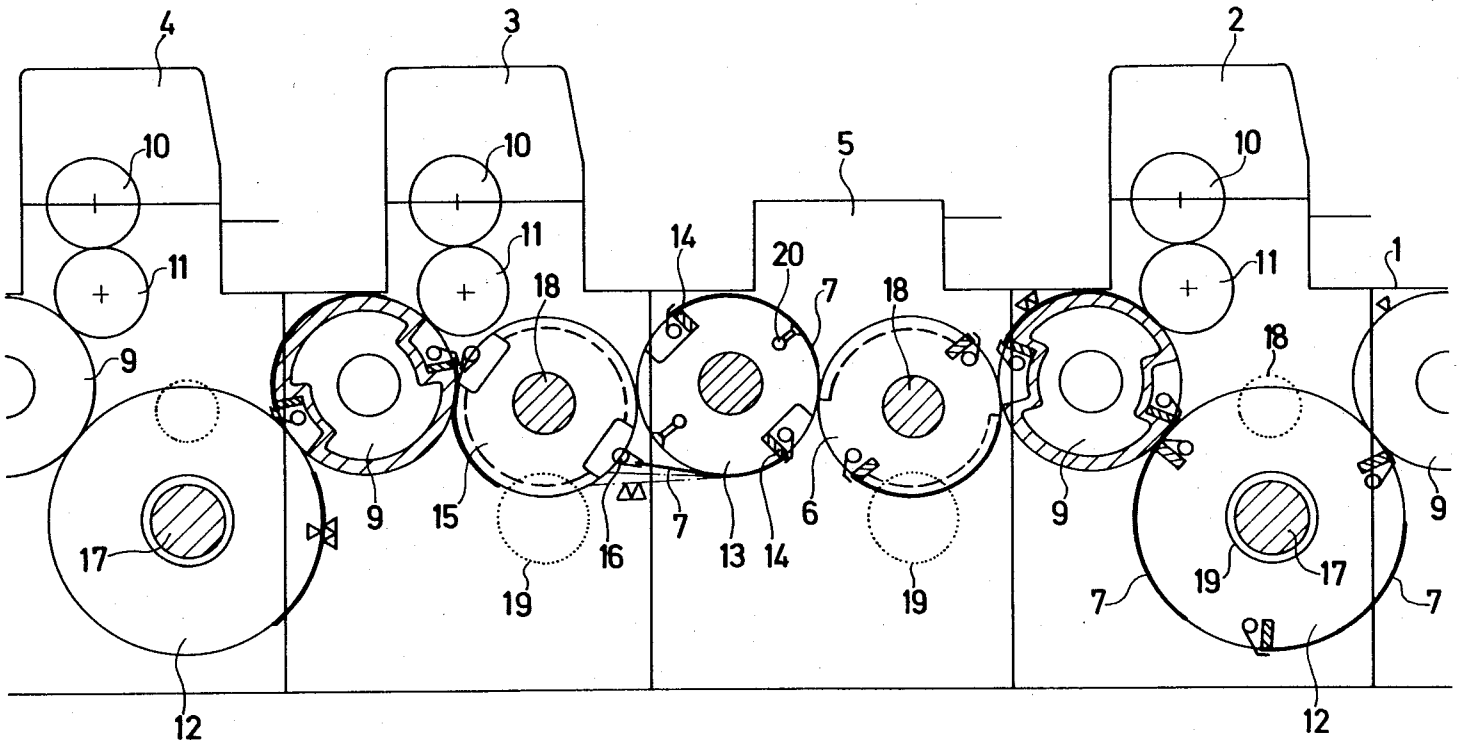
1
2
3
4
5
6
7
9
10
11
12
13
14
15
16
17
18
19
20

SHEET-FED ROTARY PRINTING PRESSES FOR SINGLE-SIDE PRINTING OR FIRST FORM AND PERFECTOR PRINTING

The invention relates to a sheet-fed rotary printing press for single-side multicolor printing or first form and perfector printing having a plurality of printing units in tandem or series construction with devices for processing both paper as well as cardboard or heavier paperboard, each printing-unit having a plate cylinder and a rubber or blanket cylinder of equal given diameter, an impression cylinder double the given diameter, and a sheet transfer drum or cylinder.

A multicolor sheet-fed rotary printing press of the type outlined hereinabove is already known from German Published Non-Prosecuted Application (DE-OS) No. 24 52 167. The impression cylinder of each printing unit in this press and a sheet turning or turnover cylinder arranged between to of the printing units are double the given diameter. A sucker system arranged on the sheet turnover cylinder engages the trailing edge of the freshly printed sheet lying on the smooth sheet-carrying surface of the impression cylinder, at the tangent point of the two cylinders. After moving in within the circumference of the sheet turnover cylinder, the sucker system transfers the engaged trailing edge to a gripper system, said gripper system then swings out again as the sheet turnover cylinder continues to rotate, and then presents the trailing edge of the sheet to the gripper system of the next following impression cylinder. The sucker system is constructed as part of a coupled double rocker arm in order to achieve a sheet transfer while maintaining the sheet in-register.

The relatively large diameter of the sheet-carrying cylinder clearly ensures the suitability of conventional multicolor sheet-fed rotary printing presses for processing cardboard or heavy paperboard but, because the trailing edge of the sheet has to be lifted off the smooth counterpressure or impression surface of the impression cylinder by means of a sucker system, the impression cylinder by means of a sucker system, the rear part of the sheet unavoidably becomes creased when the trailing edge of the sheet is passed on to the sheet turnover cylinder gripper system, despite the use of a double rocker arm, making the processing of thicker paperboard or cardboard possible, if at all, only at low speeds because, especially at higher press speeds, the creasing of the trailing edge of the sheet causes the sheet to be torn away from the sucker system because of the stiffness of the board. In this sheet turning or turnover system there must also be print-free areas available for so-called press-on segments.

Also known heretofore from German Published Prosecuted Application (DE-AS) No. 2 305 132 is a sheet turnover or turning device for rotary printing presses having an in-tandem or serial construction in which the impression cylinders of successive printing units are interconnected by a single sheet transfer drum or cylinder. Two pairs of gripper systems formed of two interacting rows of clamping grippers are arranged in the impression cylinder to turn the sheet over, the two pairs of gripper systems following the sheet-transfer drum in the direction of transport. The impression cylinder and the sheet-transfer drum are double the diameter of the plate and blanket cylinder. Suction boxes are provided above the sheet transfer drum which slightly lift the sheet to be turned off the surface of the sheet transfer drum the instant a row of clamping grippers of the next following impression cylinder has engaged the trailing edge of the sheet. During the sheet turn-over process i.e. while the trailing edge of the sheet is being transferred from the one gripper system to the other, the sheet to be turned is kept taut by the suction boxes. Indeed, the suction boxes engage the non-printed side of the sheet but, the instant the impression-cylinder gripper systems remove the then-trailing edge of the sheet from the last suction box after the turnover operation, the printed lower side of the sheet may strike the surface of the sheet transfer drum or the surface of the impression cylinder then carrying the sheet, resulting in unavoidable smudging of the printed image. This drawback aside, the trailing edge of the sheet can cardly be transferred without becoming creased, when two rows of grippers are used which come into action for the respective sheet turnover operation. With thicker paperboard or cardboard, this would result in permanent, unacceptable deformation. Moreover, greatly curved or bent board edges cause operational trouble by striking the edges of the following grippers, thereby preventing correct apprehension or seizure of the board.

Finally, a sheet-fed rotary printing press constructed of sets or units with a device for alternative single side and both first form and perfector printing is known from German Published Non-Prosecuted Application (DE-OS) No. 26 39 900 in which a component constructed as an independent element or unit is arranged between like printing units and has a transfer cylinder and a following sheet turnover or turning drum of the type mentioned hereinbefore. The transfer cylinder works in conjunction with one or two drying devices. This component has the disadvantage that its side walls are not identical with those of the lower sections of the printing unit. Thus, the component has to be specially manufactured. Furthermore, in this case, too, the sheet is quite obviously sucked away from the transfer cylinder by the gripper devices in the sheet turnover drum and passed on to other gripper devices so that it may be turned over. Creasing of the edges of stiffer board is unavoidable in the process, as explained hereintofore in greater detail. Detachment or tearing away the board from the suction system, also has to be provided for.

It is accordingly an object of the invention to provide a high-performance sheet-fed rotary offset printing press modifiable at any time for single-side multicolor printing or convertible from single-side printing to first form and perfector printing. The aim is to ensure smudge-free processing of stock ranging from paper to thick paperboard or cardboard. It is most desirable to employ the same printing-unit side walls in both types of press construction.

With the forgoing and other object in view, there is provided, in accordance with the invention, sheet-fed rotary printing press for single-side multicolor printing or for first form and perfector printing having a plurality of printing units disposed in tandem and having devices for processing both paper as well as heavier paperboard, each of the plurality of printing units having a plate cylinder and a blanket cylinder of equal given diameter in mutually cooperative relationship as well as an impression cylinder operatively engaging the blanket cylinder and having a diameter double the given diameter, and a sheet transfer cylinder in mutually cooperative relationship with the impression cylinder, each of the printing units includes an upper part and a lower part, the lower part thereof having two opposite side walls each formed with two bearing holes, respectively, located vertically above one another for receiving therein respective bearings for sheet transfer cylinders, the lower of the two vertically disposed bearing holes being of such size as to accommodate a bearing for a journal of a sheet transfer cylinder having a diameter triple that of the given diameter, and the upper of the bearing holes being of such size as to accommodate a bearing for a journal of a sheet transfer cylinder having a diameter double that of the given diameter.

In accordance with another feature of the invention, the sheet transfer cylinder is a sheet turnover cylinder having two tongs-gripper systems mounted thereon mutually offset circumferentially by 180°.

In accordance with a further feature of the invention, the lower bearing hole is spaced a distance equal to one and one-half times the given diameter from the circumferential surface of the impression cylinder, and the upper bearing hole is spaced a distance equal to the given diameter from the circumferential surface of the impression cylinder.

In accordance with an added feature of the invention, only one of the double-diameter and triple-diameter sheet transfer cylinders is mountable in the respective printing units, at least one of the plurality of printing units having a triple-diameter sheet transfer cylinder journalled in the lower bearing hole thereof, and at least another of the plurality of printing units having a double-diameter sheet transfer cylinder journalled in the upper bearing hole thereof.

A sheet-fed rotary printing press according to the invention can be constructed so as to provide triple-diameter sheet-transfer drums interacting with the printing cylinders in the printing-unit lower sections. If this is the case, the invention is particularly advantageous for single-side multicolor printing of thick paperboard or cardboard. Apart from the gripper systems which have engaged the leading edge of the sheet, the triple-diameter sheet-transfer drums have no other guiding elements. Because of the slight curvature of the sheet-transfer drums, there is little risk that the printed side of a transported sheet will strike the drum shaft and that the printed image will thereby be smudged.

For an embodiment of the invention to be convertible from single-side printing to first form and perfector printing, it must have at least one sheet turning or turnover station. In such a sheet-fed rotary printing press, in accordance with a concomitent feature of the invention, there is provided a lower part of a printing unit disposed between two of the plurality of printing units and carrying a storage cylinder having a diameter double that of the given diameter at a location thereof, normally occupied by the impression cylinder, the last-mentioned printing-unit lower part also having a double-diameter sheet transfer cylinder journalled in the upper bearing hole thereof. In the printing unit next following this the latter lower part of a printing unit, a sheet turnover cylinder is mounted instead of a double-diameter sheet-transfer drum. It proves advantageous in the case of this cylinder arrangement to provided only two tongs-gripper systems in the sheet turnover drum instead of three such systems, two gripper systems being much easier to control than three with regard to maintaining good sheet register during the turning process. On the other hand, however, double diameter sheet transfer drums also permit thick board to be processed well.

Should the job structure at the printing plant change, for example, during the course of production on a board-printing press according to the invention, one of the two embodiments can be converted to the other at the printing establishment because the necessary provisions have already been made in the side walls. But even if both types of presses i.e. a sheet-fed rotary printing press for single-side multicolor printing and a convertible first form and perfector printing press, are supplied in parallel, use of of the side walls according to the invention is economical from the standpoint of manufacturing technology and advantageous with regard to production and assembly planning, whether or not conversion is subsequently effect.

Other features which are considered as characteristic for the invention are set forth in the appended claims.

Although the invention is illustrated and described herein as embodied in sheet-fed rotary printing presses for single-side printing or first form and perfector printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments in which the single FIGURE of the drawing is a diagrammatic elevational view of a four-color cardboard-printing press which is convertible to a two/two first form and perfector printing press.

Referring now to the drawing, there is shown only partly therein a cardboard-printing press having printing units 1, 2 3 and 4, a printing unit lower section 5 equipped with parts of a sheet turnover station being inserted between the printing unit 2 and the printing unit 3. Sheets 7 to be processes are fed to a printing cylinder 9 of the printing unit 1 by a sheet feeder not shown in the drawing. The sheet 7 receives its first imprint by means of a plate cylinder 10 and a rubber or blanket cylinder 11 both of which are of equal given diameter. Because the printing cylinder 9 is double the diameter of the plate or blanket cylinders 10 and 11, it has two sheet carrying surfaces. The printing cylinder 9 passes the printed sheet 7 on to a sheet transfer drum 12 of the printing unit 2 which is triple the diameter of the plate or blanket cylinder 10 and 11. The sheet 7 is then received by the printing cylinder 9 of the printing unit 2. The second color is printed there by means of the plate cylinder 10 and the blanket or rubber cylinder 11.

As mentioned herein above, the printing-unit lower section 5 is connected to the printing unit 2, a double-diameter sheet-transfer drum 6 and the storage drum 13, also of double diameter, being mounted in the printing-unit lower section 5. The storage drum 13 thus takes the place of a printing cylinder 9.

The sheet 7, which has now had two printings thereon, is therefore there taken over by the sheet-transfer drum 6 of the printing-unit lower section 5 and passed on to the storage drum 13. One of two gripper systems 14 arranged at an offset of 180° from one another at the circumference of the storage drum 13 engages the straightened leading edge of the sheet 7. A suction device 20 pneumatically engages the trailing edge of the sheet 7 and tautens it circumferentially and laterally. In the next printing unit 3, a sheet turnover cylinder 15 is mounted instead of a sheet transfer drum 6. The sheet turnover cylinder 15 is of double diameter and thus has two tongs-gripper systems 16 arranged symmetrically on the circumference thereof. As the FIGURE shows, with the cardboard-printing press set up for first form and perfector printing, one of the tongs-gripper systems 16 grasps the trailing edge of the sheet 7, then presenting it to printing cylinder 9 of the printing unit 3 with the trailing-edge thereof in a leading or forward position. The first perfector printing operation is performed there by means of the plate cylinder 10 and the rubber or blanket cylinder 11. The sheet turnover station is thus formed of the three sheet-carrying drums, namely the sheet-transfer drum 6, the storage drum 13 and the sheet turnover cylinder 15, and is divided among two normal i.e. similarly arranged, printing-unit lower sections.

The printing unit 4 is arranged exactly the same way as is the printing unit 2. Thus, it also has a triple-diameter sheet-transfer drum 12, a double-diameter printing cylinder 9 and given or single-diameter plate and rubber or blanket cylinders 10 and 11. In this printing unit 4, the sheet 7 receives its second perfector printing and is then delivered to a delivery pile by a sheet-delivery device not shown in the drawing. In the printing units 3 and 4, the printing cylinder is advantageously provided with suitable coverings or coatings favorable to surrendering or transferring ink.

With respect to the dimensions and machining and mechanical treatment thereof, the printing-unit lower section 5 is exactly the same as the lower sections of the printing units 2, 3 and 4. Two bearing-holes 18 and 19 are provided vertically above one another in the side walls of these printing-unit lower sections. The upper, somewhat slightly smaller bearing hole 18 serves to receive the bearing of the double-diameter sheet-transfer drum 6. The lower, larger bearing hole 19 serves to receive the bearings of triple-diameter sheet-transfer drums 12. Through the use of the same printing-unit lower sections also for the sheet-transport device of the sheet turnover station and through the arrangement of the two bearing holes 18 and 19 vertically above one another, it is possible, on the one hand, to use the side walls of the printing-unit lower sections for two separate types of cardboard-printing presses and, on the other hand, and this is a particular advantage, to convert one type of press to the other type at any time after delivery, if the job structure changes.

If the owner of a sheet-fed rotary printing press according to the invention wishes to perform only single-side multicolor printing, and principally on cardboard, it is advantageous to equip all printing-unit lower sections with triple-diameter sheet-transfer drums 12 because there is then very little risk that the printed side of the sheet will strike the shaft 17 of a sheet-transfer drum 12, even when the press is only run slowly and very stiff cardboard is used. This means that triple-diameter sheet transfer drums afford a greater assurance of transporting stiff cardboard without smudging than smaller-diameter drums unless the sheet transfer drums are equipped with covering metal sheets which prevent the freshly printed underside of the sheet from smudging.

If, however, the job structure makes the use of a first form and perfector printing press appear advantageous, the embodiments with only double-diameter sheet-transfer drums shown in the FIGURE is more suitable. The entire sheet turnover station is equipped with.less of a gripper system and is thus easier to adjust. Furthermore, sheet transfer is better because of the particular arrangement of the cylinders with respect to one another.

In very general terms, both of the aforedescribed cardboard-printing press types have the advantage that, because of the large diameters of the sheet-carrying cylinders of drums, even thick cardboard is transported trouble-free, reliably and without smudging. Creasing of the leading and trailing edges, respectively, of the cardboard can be prevented due to the use of tongs-grippers. The use of a storage drum, with integrated format adjustment facilities and provided with rotary suckers at the trailing edge of sheets stored thereon, enables a far higher quality standard to be attained than with heretoforeknown sheet turnover devices. All in all, The multicolor printing press described affords the possibility of processing both paper as well as thicker cardboard in correct register and without smudging over the entire format range, even at high printing speeds. It is significant that the printing-unit lower section 5 can also be provided between the printing units 1 and 2 or the printing units 3 and 4. It is especially advantageous that the side walls of the printing units 2, 3, 4 and 5 can have an absolutely identical construction.

The foregoing is a description corresponding, in substance, to German application P No. 34 18 443.0, dated May 18, 1984, International priority of which is being claimed for the instant application, and which is hereby made part of this application. Any material discrepancies between the foregoing specification and the specification of the aforementioned corresponding German application are to be resolved in favor of the latter.

There is claimed:

1. Sheet-fed rotary printing press for single-side multicolor printing or for first form and perfector printing comprising a plurality of printing units disposed in tandem and having devices for processing both paper as well as heavier paper-board, each of the plurality of printing units having a plate cylinder and a blanket cylinder of equal given diameter in mutually cooperative relationship as well as an impression cylinder operatively engaging the blanket cylinder and having a diameter double the given diameter, and a sheet transfer cylinder in mutually cooperative relationship with the impression cylinder, each of the printing units comprising an upper part and a lower part, said lower part thereof having two opposite side walls each formed with two bearing holes, respectively, located vertically above one another for alternatively receiving therein respective bearings for sheet transfer cylinders, the lower of said two vertically disposed bearing holes being of such size as to accommodate a bearing for a journal of a sheet transfer cylinder having a diameter triple that of said given diameter, and the upper of said bearing holes being of such size as to accommodate a bearing for a journal of a sheet transfer cylinder having a diameter, double that of said given diameter and another printing unit formed exclusively of said lower part and being disposed between a given one of the plurality of printing units located downstream therefrom in travel direction of a sheet through the printing press and another of the plurality of printing units located upstream therefrom and carrying a storage cylinder having a diameter double that of the given diameter at a location thereof normally occupied by the impression cylinder, said last-mentioned printing-unit lower part also having a double-diameter sheet transfer cylinder journalled in said upper bearing hole thereof, the sheet transfer cylinder in said other of the plurality of printing units located upstream of said last-mentioned printing-unit lower part being a sheet turnover cylinder having two tongs-gripper systems mounted thereon mutually offset circumferentially by 180°.

2. Sheet-fed rotary printing press according to claim 1 wherein said lower bearing hole is spaced a distance equal to one and one-half times the given diameter from the circumferential surface of the impression cylinder, and said upper bearing hole is spaced a distance equal to the given diameter from the circumferential surface of the impression cylinder.

3. Sheet-fed rotary printing press according to claim 1 wherein only one of said double-diameter and triple-diameter sheet transfer cylinders is mountable in the respective printing units, at least one of the plurality of printing units having a triple-diameter sheet transfer cylinder journalled in said lower bearing hole thereof, and at least another of the plurality of printing units having a double-diameter sheet transfer cylinder journalled in said upper bearing hole thereof.

* * * * *